US009711871B2

(12) United States Patent
Jones

(10) Patent No.: US 9,711,871 B2
(45) Date of Patent: Jul. 18, 2017

(54) HIGH-BAND RADIATORS WITH EXTENDED-LENGTH FEED STALKS SUITABLE FOR BASESTATION ANTENNAS

(71) Applicant: CommScope Technologies LLC, Hickory, NC (US)

(72) Inventor: Bevan Beresford Jones, Epping (AU)

(73) Assignee: CommScope Technologies LLC, Hickory, NC (US)

( * ) Notice: Subject to any disclaimer, the term of this patent is extended or adjusted under 35 U.S.C. 154(b) by 476 days.

(21) Appl. No.: 14/479,102

(22) Filed: Sep. 5, 2014

(65) Prior Publication Data

US 2015/0070234 A1 Mar. 12, 2015

(51) Int. Cl.

| | |
|---|---|
| ***H01Q 21/28*** | (2006.01) |
| ***H01Q 21/26*** | (2006.01) |
| ***H01Q 1/12*** | (2006.01) |
| ***H01Q 5/40*** | (2015.01) |

(52) U.S. Cl.

CPC ..... *H01Q 21/28* (2013.01); *H01Q 1/12* (2013.01); *H01Q 5/40* (2015.01); *H01Q 21/26* (2013.01)

(58) Field of Classification Search

CPC H01Q 21/28; H01Q 5/40; H01Q 1/12; H01Q 21/26

USPC ..... 343/798

See application file for complete search history.

(56) References Cited

U.S. PATENT DOCUMENTS

2002/0126060 A1 9/2002 Schadler
2005/0057417 A1* 3/2005 Teillet ..... H01Q 1/246 343/797
2010/0007571 A1 1/2010 Riedel
2011/0063190 A1* 3/2011 Ho ..... H01Q 1/526 343/912
2012/0280878 A1* 11/2012 Timofeev ..... H01Q 1/246 343/793

FOREIGN PATENT DOCUMENTS

EP 2 503 640 A1 3/2012
FR 2 939 569 12/2008

OTHER PUBLICATIONS

International Search report regarding related international application PCT/US2014/054819, Mailed Mar. 25, 2015 (4pgs.).

(Continued)

*Primary Examiner* — Dameon E Levi
*Assistant Examiner* — Andrea Lindgren Baltzell
(74) *Attorney, Agent, or Firm* — Myers Bigel, P.A.

(57) ABSTRACT

A high-band radiator of an ultra-wideband dual-band basestation antenna is disclosed. The high-band radiator comprises at least one dipole, a feed stalk, and a tubular body made of conductive material and having an annular flange. Each dipole comprises two dipole arms made of conductive material. The feed stalk feeds the dipole and comprises a non-conductive dielectric substrate body and conductors formed on the substrate body to function as a balun transformer. The feed stalk is connected with the dipole at one end and has at least one feed connector at the other, with the conductors coupled there-between. The tubular body is adapted for electrical connection through the annular flange to the ground plane at the open end; the body is short-circuited at the other end to define an internal cavity of the tubular body. At least a portion of the feed stalk is disposed within the tubular body.

19 Claims, 4 Drawing Sheets

(56) References Cited

OTHER PUBLICATIONS

Written Opinion regarding related international application PCT/US2014/054819, Mailed Mar. 25, 2015 (6pgs.).
International Preliminary Report on Patentability Corresponding to International Application No. PCT/US2014/054819; Date of Mailing: Mar. 24, 2016; 8 Pages.

* cited by examiner

HIGH-BAND RADIATORS WITH EXTENDED-LENGTH FEED STALKS SUITABLE FOR BASESTATION ANTENNAS

This application claims priority to and incorporates by reference Australian Provisional Patent Application No. AU 2013903473 filed 11 Sep. 2013 and titled: "High-band Radiators In Moats For Basestation Antennas."

FIELD OF THE INVENTION

The present invention relates generally to antennas for cellular systems and in particular to antennas for cellular basestations.

BACKGROUND

Developments in wireless technology typically require wireless operators to deploy new antenna equipment in their networks. Disadvantageously, towers have become cluttered with multiple antennas while installation and maintenance have become more complicated. Basestation antennas typically covered a single narrow band. This has resulted in a plethora of antennas being installed at a site. Local governments have imposed restrictions and made getting approval for new sites difficult due to the visual pollution of so many antennas. Some antenna designs have attempted to combine two bands and extend bandwidth, but still many antennas are required due to the proliferation of many air-interface standards and bands.

SUMMARY

In accordance with an aspect of the invention, there is provided a high-band radiator of an ultra-wideband dual-band cellular basestation antenna. The dual bands comprise low and high bands. The high-band radiator comprises at least one dipole, a feed stalk, and a tubular or substantially tubular body made of conductive material and having an annular or substantially annular flange. The at least one dipole comprises two dipole arms made of conductive material adapted for the high band. The feed stalk feeds the at least one dipole and comprises a non-conductive dielectric substrate body and conductors formed on the substrate body adapted to function as a balun transformer. The feed stalk is connected with the at least one dipole at one end and having at least one coaxial cable feed at the other end. The conductors are coupled to the at least one dipole and the at least one cable feed. The tubular or substantially tubular body is adapted for connection with a groundplane of the dual-band cellular basestation antenna. The tubular body is electrically connected, either directly or by capacitive coupling, through the annular flange to the ground plane at the open end and short-circuited at the other end to define an internal cavity of the tubular body. At least a portion of the feed stalk is disposed within the tubular body through the open end. The tubular body is adapted to have the feed connections extend through the tubular body at the short circuited end.

In one example a high band radiating element comprises a feed stalk including a balun, a dipole having two dipole arms mounted on the feed stalk, each dipole arm having a length approximately one-quarter of a wavelength of an intended frequency of operation for the dipole, and a recessed choke referred to here as a 'moat' having a mounting surface for the feed stalk and a flange adapted to be mounted on a ground plane. The feed stalk is dimensioned to have a length that is longer than one-quarter of the wavelength of the intended frequency of operation for the dipole, and the dipole arms are located above the flange of the moat by approximately one-quarter of the wavelength of the intended frequency of operation.

Preferably, the high-band radiator comprises a pair of crossed dipoles for dual polarization, each dipole comprising two dipole arms made of conductive material adapted for the high band. The tubular body may be cylindrical, substantially cylindrical, hexagonal, or other polygonal form.

The tubular body is adapted to have a length for enclosing a portion of the feed stalk in the internal cavity of the tubular body; the length is dependent upon the high-band and low-band ranges of frequencies, so that the common mode resonance of the high-band radiator falls below the low-band range of frequencies.

The high-band radiator may be adapted for the frequency range of 1710-2690 MHz. A low-band radiator may be adapted for all or part of the frequency range of 698-960 MHz.

In accordance with a further aspect of the invention, there is provided an ultra-wideband cellular dual-band basestation antenna. The dual band has low and high bands suitable for cellular communications. The dual-band antenna comprises a number of low-band radiators and a number of high-band radiators as set forth in the foregoing aspects of the invention. The low-band radiators are each adapted for providing clear areas on a groundplane of the dual-band antenna for locating high band radiators in the dual-band antenna. The high band radiators are configured in at least one array, where the low-band radiators are interspersed amongst the high-band radiators at predetermined intervals.

The ultra-wideband antenna further comprises a groundplane having apertures formed in the groundplane. Each high-band radiator is disposed in a respective aperture formed in the groundplane. The ultra-wideband antenna further comprises a number of annular dielectric discs; each dielectric disc is disposed around the tubular body of a respective high-band radiator and between the annular flange of the high-band radiator and the groundplane.

Each low-band radiator may be adapted for all or part of the frequency range of 698-960 MHz.

BRIEF DESCRIPTION OF DRAWINGS

Arrangements of ultra-wideband dual-band cellular basestation antennas are described hereinafter, by way of an example only, with reference to the accompanying drawings, in which.

DETAILED DESCRIPTION

Figure 1:
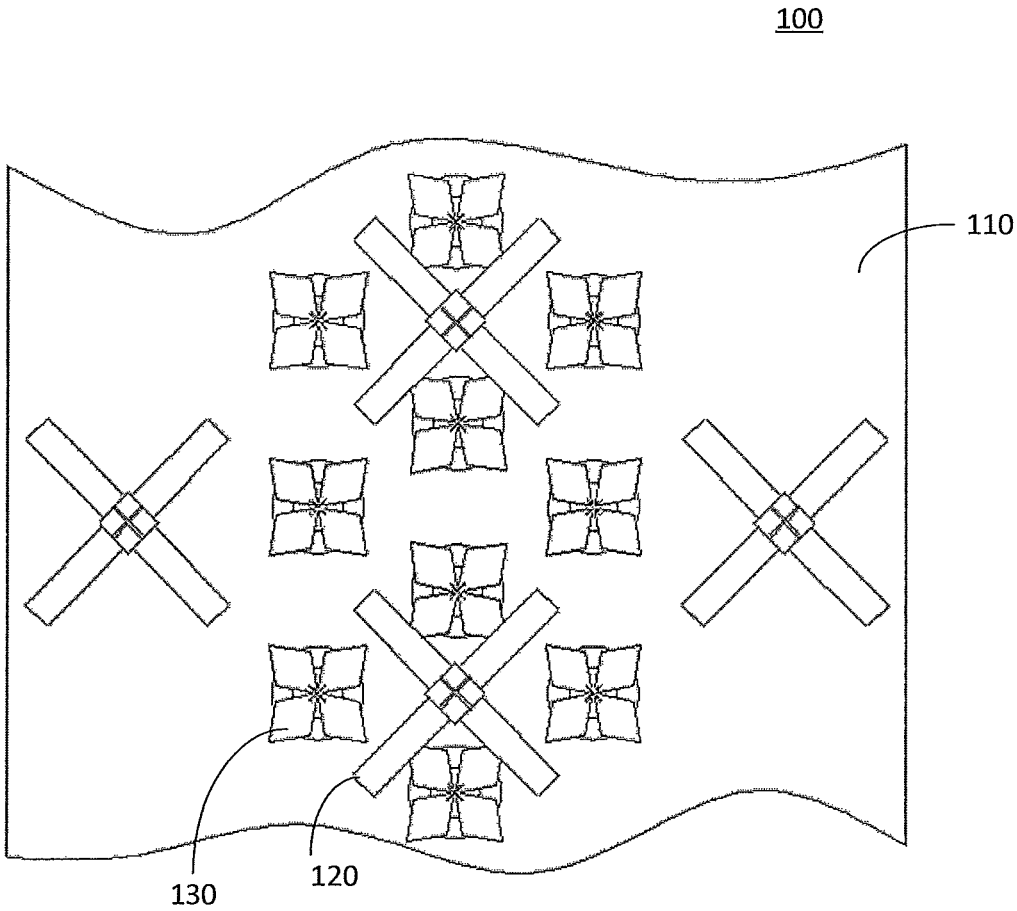
FIG. 1 is a top plan view of a portion or section of an ultra-wideband, dual-band cellular basestation antenna comprising high-frequency band and low-frequency band antenna elements.

Ultra-wideband dual-band cellular basestation antennas and high-band radiators for such antennas are disclosed hereinafter. In the following description, numerous specific details, including particular beamwidths, air-interface standards, dipole arm shapes and materials, and the like are set forth. However, from this disclosure, it will be apparent to those skilled in the art that modifications and/or substitutions may be made without departing from the scope and spirit of the invention. In other circumstances, certain details may be omitted so as not to obscure the invention.

Unless defined otherwise, all technical and scientific terms used herein have the same meaning as commonly understood by those of ordinary skill in the art to which the invention belongs. The articles "a" and "an" are used herein to refer to one or to more than one (i.e. to at least one) of the grammatical object of the article. By way of example, "an element" refers to one element or more than one element. Throughout this specification, unless the context requires otherwise, the words "comprise", "comprises" and "comprising" will be understood to imply the inclusion of a stated step or element or group of steps or elements, but not the exclusion of any other step or element or group of steps or elements.

As used hereinafter, "low band" refers to a lower frequency band, such as 698-960 MHz or a portion thereof, and "high band" refers to a higher frequency band, such as 1710 MHz-2690 MHz or a portion thereof. This invention may also be applicable to additional high and low bands outside these ranges where the high band is approximately twice the frequency of the low band. A "low-band radiator" refers to a radiator for such a lower frequency band, and a "high-band radiator" refers to a radiator for such a higher frequency band. The "dual band" comprises the low and high bands referred to throughout this disclosure.

In the following description, "ultra-wideband" with reference to an antenna and/or radiating element connotes that the antenna is capable of operating and maintaining its desired characteristics over a bandwidth of at least 30% of the midpoint operating frequency. Characteristics of particular interest are the beam width and shape and the return loss, which needs to be maintained at a level of at least 15 dB across this band. In one example disclosed herein, an ultra-wideband dual-band antenna covers the bands 698-960 MHz and 1710 MHz-2690 MHz using different ultra-wideband radiating elements for the two bands. This covers almost the entire bandwidth assigned for all major cellular systems.

The embodiments of the invention preferably relate to ultra-wideband dual-band antennas and high-band radiators for such an antenna adapted to support emerging network technologies. The embodiments of the invention enable operators of cellular systems ("wireless operators") to use a single type of antenna covering a large number of bands, where multiple antennas were previously required. The embodiments of the invention are capable of supporting several major air-interface standards in almost all the assigned cellular frequency bands. The embodiments of the invention allow wireless operators to reduce the number of antennas in their networks, lowering tower leasing costs while increasing speed to market capability.

A dual band, ultra-wideband antenna as disclosed herein helps solve problems in the art of multiple antennas cluttering towers and associated difficulties with the complicated installation and maintenance of multiple antennas by, in one antenna, supporting multiple frequency bands and technology standards. The present invention enables use of such ultra-wideband radiating elements while reducing undesirable common-mode scattering from the high band dipoles that may otherwise degrade antenna performance at low-band.

Deploying an ultra-wideband dual-band cellular basestation antenna in accordance with an embodiment of the invention can save operators time and expense during their next technology rollouts. Such an antenna provides a future-ready solution for launching a high performance wireless network with multiple air-interface technologies using multiple frequency bands. Deploying such a flexible, scalable and independently optimized antenna technology simplifies the network, while providing the operator with significant future ready capacity. Such an antenna is optimized for high performance in capacity-sensitive data-driven systems. The preferred embodiments of the invention utilize dual orthogonal polarizations and support multiple-input and multiple-output (MIMO) implementations for advanced capacity solutions. The embodiments of the invention support multiple bands presently and in the future as new standards and bands emerge, protecting wireless operators from some of the uncertainty inherent in wireless technology evolution.

The following embodiments of the invention support multiple frequency bands and technology standards. For example, wireless operators can deploy using a single antenna Long Term Evolution (LTE) network for wireless communications in 2.6 GHz and 700 MHz, while supporting Wideband Code Division Multiple Access (W-CDMA) network in 2.1 GHz. For ease of description, the antenna array is considered to be aligned vertically.

An antenna in accordance with an embodiment of the invention provides a dual-band solution, which can for example add five lower frequency bands making the antenna capable of supporting nine frequency bands across the wireless spectrum for all four air-interface standards: Global System for Mobile Communications (GSM), Code Division Multiple Access (CDMA), W-CDMA and LTE. Other relevant interfaces include WiMax and GPRS.

FIG. 1 illustrates part of an ultra-wideband, dual-band cellular basestation antenna 100 comprising high-frequency band antenna elements 130 and low-frequency band antenna elements 120, located above a groundplane 110. The drawing shows the general arrangement of high-band radiators 130 in accordance with embodiments of the invention interspersed with low-band radiators 120.

The high-band radiators 130 are disposed in "moats", as explained hereinafter, to lengthen the inductive portion of the dipole of the high-band radiator into the groundplane. The "moat" dipoles vary the common mode resonant frequency. The dual-band antenna 100 of FIG. 1 comprises a number of low-band radiators 120 and a number of such high-band radiators 130. The low-band radiators 120 are each adapted for providing clear areas on the groundplane 110 for locating the high-band radiators 130. The high band radiators 130 are configured in at least one array, where the low-band radiators 120 are interspersed amongst the high-band radiators 130 at predetermined intervals. Preferably, the groundplane 110 has apertures (not shown in FIG. 1) formed in the groundplane 110. Each high-band radiator 130 is configured or disposed in a respective aperture formed in the groundplane 110. In FIG. 1, a pair of crossed (or orthogonally disposed) dipoles for dual polarization operation is shown. However, in an alternative embodiment of the invention, a single dipole for single linear polarization operation may be practiced.

In such dual-band antennas 100 (in particular, cellular basestation antennas) comprising interspersed arrays of high- and low-band radiators (e.g., dipoles) above a ground plane, a monopole (common mode) resonance in the high-band dipoles can cause a major disturbance to the pattern of the low-band radiators. The feeds of the high-band dipoles typically comprise cables, tubes or printed circuits connecting the dipole arms to the groundplane, often forming a balun. The monopole resonance involves the inductance of the central feed of the high-band dipoles resonating with the capacitance of the dipole arms against the groundplane within the intended low band. At low-band the radiation from the induced current in the high-band dipole stems occurs at wide angles from boresight and is particularly evident in the azimuth patterns measured in horizontal polarization.

Dipole antennas typically comprise quarter-wavelength dipole arms spaced approximately one-quarter wavelength from a ground plane. When a high band wavelength is approximately half the low band wavelength, the combination of a high band dipole arm and its stalk may exhibit a common mode resonance in the low band. The embodiments of the invention provide a technique for tuning the monopole resonance down in frequency to remove the monopole resonance from the band of interest. The technique involves sinking a cup-like depression or recess into the groundplane below the high-band dipole, lengthening the feed structure and connecting the feed structure to the bottom of the groundplane depression. This structure maintains the relationship of the dipole arms to the ground plane while also lengthening the inductive part of the resonant circuit and lowering its resonant frequency. This technique typically has little effect on the first differential resonant mode. As explained hereinafter, the depression or recess in the groundplane is preferably implemented by forming apertures in the groundplane into which cup-like structures with an annular flange or lip is placed.

Figure 2:
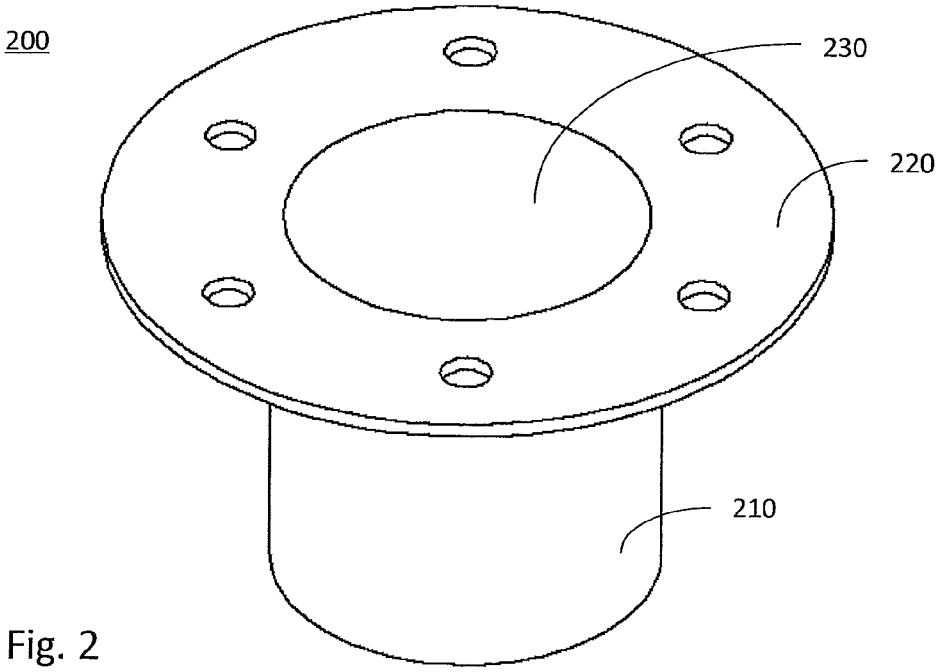
FIG. 2 is an isometric view of a tubular or substantially tubular body having an annular flange, which is a component of a high-band radiator in accordance with an embodiment of the invention and is cylindrical in form.
Figure 3:
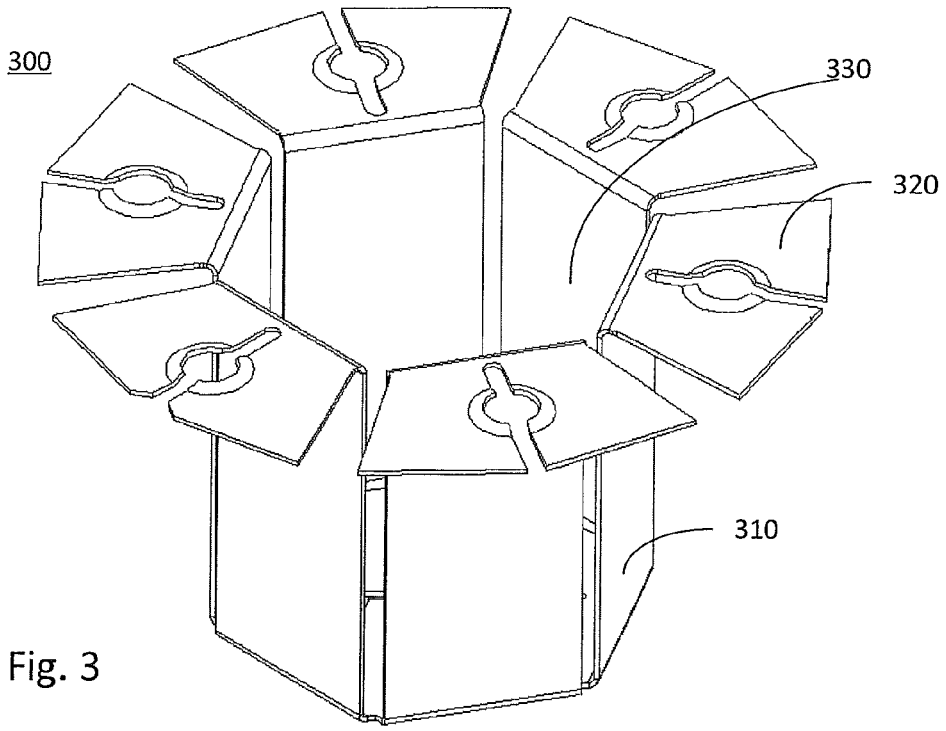
FIG. 3 is an isometric view of another tubular or substantially tubular body having an annular flange, which is a component of a high-band radiator in accordance with another embodiment of the invention and is hexagonal in form.

In accordance with the embodiments of the invention, a high-band radiator 130 comprises at least one dipole, a feed stalk, and a tubular or substantially tubular body made of conductive material (e.g., metal). FIGS. 2 and 3 illustrate two tubular bodies 200, 300 in accordance with embodiments of the invention for providing "moats" around at least a portion of respective feed stalks. The tubular body 200, 300 has an annular flange 220, as shown in FIG. 2, or a substantially annular flange 320, as shown in FIG. 3, which is formed from physically separated leaves. The open-circuited end 230, 330 is disposed at one end of the tubular body 200, 300, which forms part of the "moat." The other end of the tubular body 200, 300 is short-circuited (not shown in FIGS. 2 and 3). The tubular body 200 may have a cylindrical or slightly conical shape, and have a tubular section 210 between the open- and short-circuited ends, as shown in FIG. 2. The term "tubular" does not necessarily mean cylindrical or even a circular cross section, for example, the tubular body 300 has a substantially hexagonal body in form formed from metal segments that are physically separated, as shown in FIG. 3.

Figure 4A:
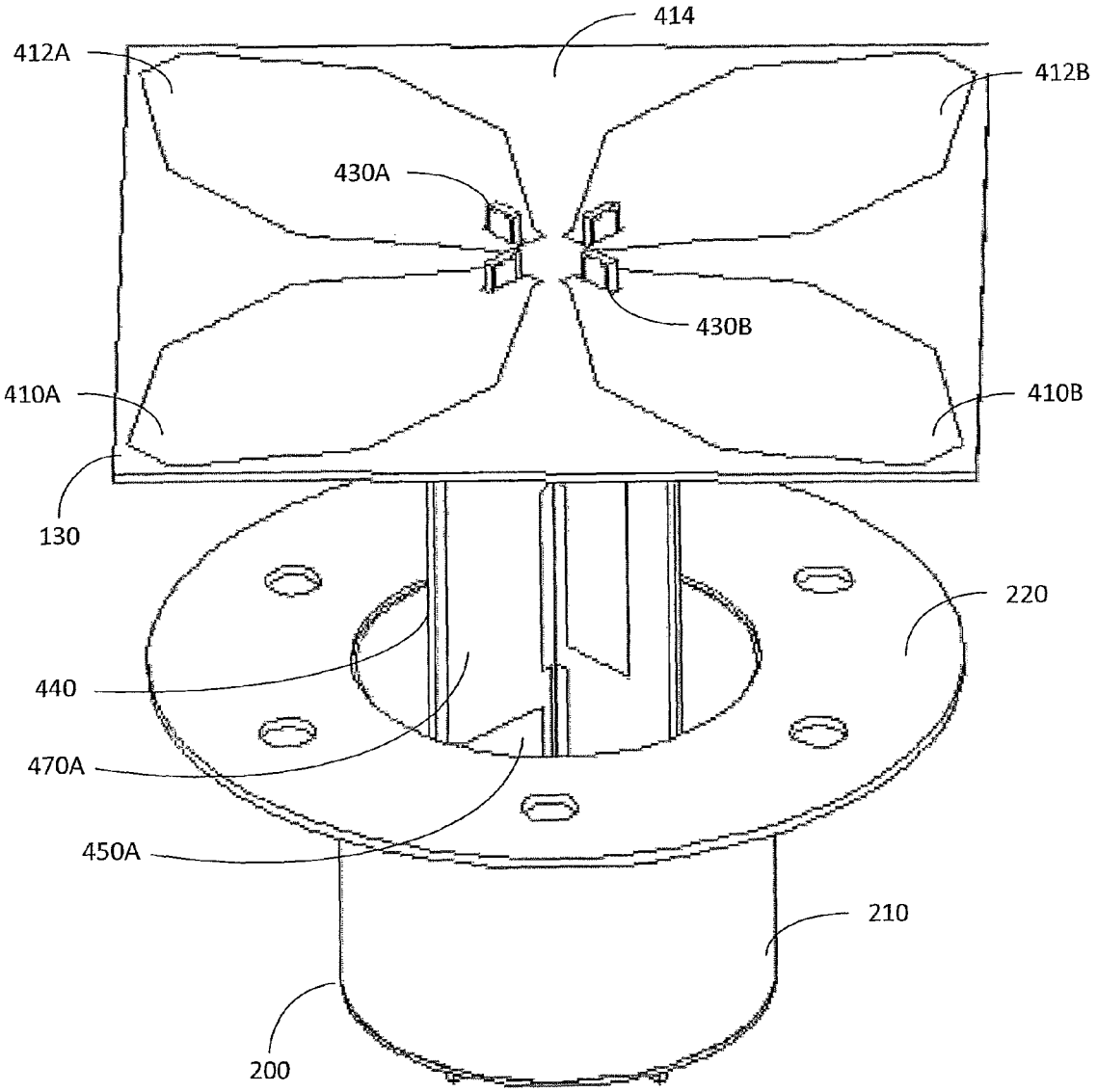
FIG. 4A is an isometric view of a high-band radiator including a tubular or substantially tubular body with an annular flange as depicted in FIG. 2 in accordance with an embodiment of the invention.
Figure 4B:
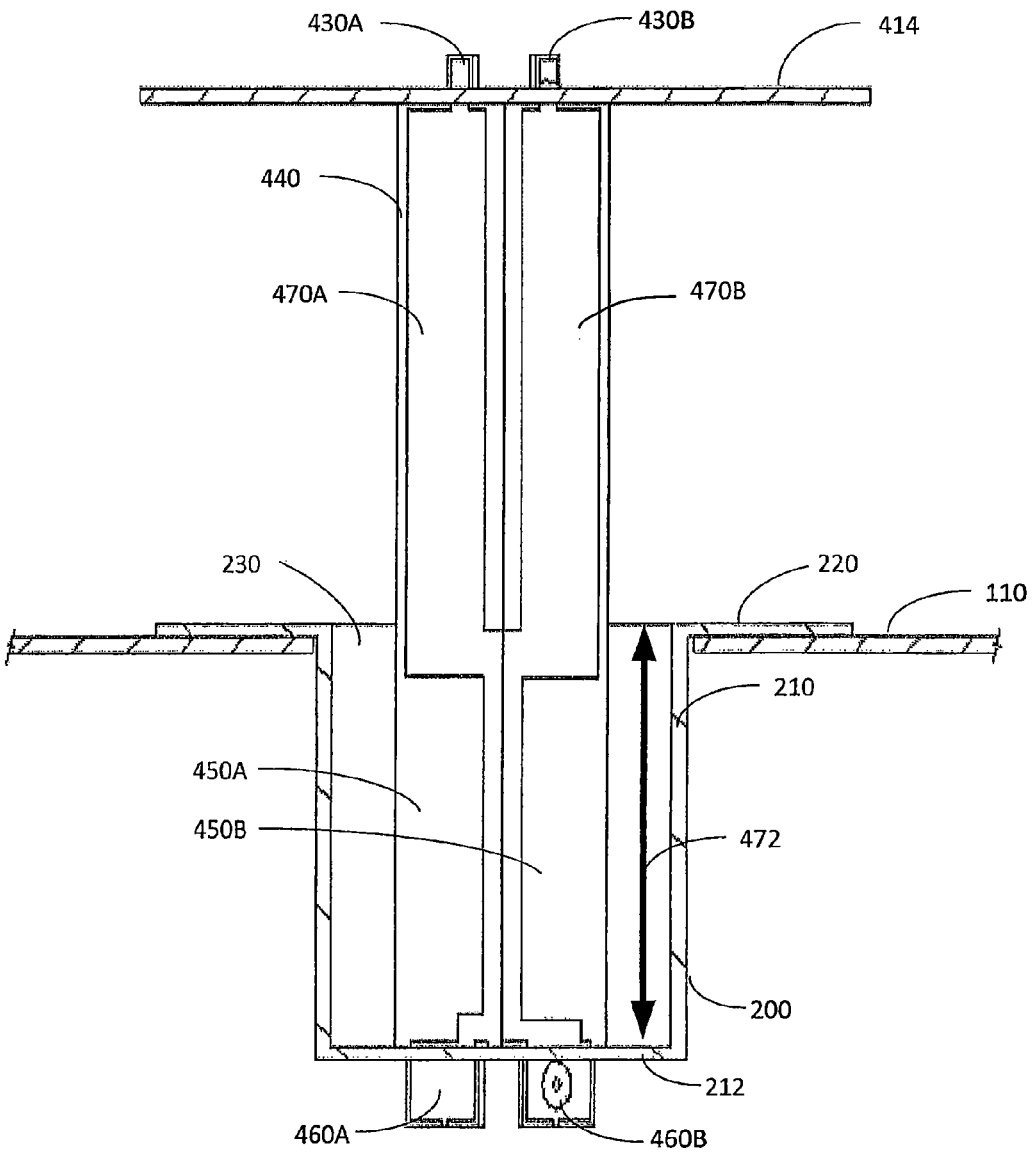
FIG. 4B is a side elevation view of the high-band radiator of FIG. 4A where the tubular body is disposed in an aperture formed in a groundplane of the basestation antenna and the annular flange is coupled to the groundplane.

A high-band radiator 130 is shown in greater detail in the isometric and side elevation views of FIGS. 4A and 4B. The high-band radiator 130, as implemented in FIGS. 4A and 4B, comprises a pair of crossed dipoles 410, 412 for dual polarization. Again, a single dipole for single linear polarization operation, or a pair of crossed (or orthogonally disposed) dipoles for dual polarization operation, may be practiced. Each dipole 410, 412 comprises two dipole arms 410A, 410B, 412A, 412B made of conductive material (e.g. microstrip, or another suitable conductor) adapted for the high band. As implemented in FIGS. 4A and 4B, the crossed dipoles 410, 412 are formed from conductive strips on the upper surface of a non-conductive dielectric board 414. A feed stalk 440 feeds the each one dipole 410, 412 and comprises one or more non-conductive dielectric substrate bodies 450 (e.g., teflon dielectric boards) and conductors 470 (e.g., copper strips) formed on each substrate body 450 adapted to function as a balun transformer. Preferably, the feed stalk 440 is made of crossed printed circuit boards but may be made wholly of metal. The feed stalk 440 is connected with a respective dipole 410, 412 at one end by conductive tabs 430 of the printed circuit boards that protrude through the substrate 414. The printed circuit boards of the feed stalk 440 have provision for connecting coaxial cables 460 at the other end that protrude through the short-circuited bottom section 212 shown in FIG. 4B. The conductors 470A, 470B are coupled to each respective dipole 410, 412 and the respective feed connections 460, which protrude from the bottom of the tubular body 200 in FIG. 4.

The tubular or substantially tubular body 200, 300 shown in FIGS. 2 and 3 is adapted for connection with the groundplane 110 of the dual-band cellular basestation antenna 100. The tubular body 200 may be cylindrical (see FIG. 2) or substantially cylindrical in form. Alternatively, the tubular body 300 may be hexagonal, or substantially hexagonal in form (see FIG. 3). As shown in FIG. 4B, the tubular body 200, 300 is electrically connected, either directly or by capacitive coupling, through the annular flange 220, 320 to the groundplane 110 at the open end 230. The open end 230, 330, the tubular section 210, 310, and the short-circuited section 212 at the other end define an internal cavity 230, 300, or moat, of the tubular body 200, 300. At least a portion (indicated by double-headed arrow 472 in FIG. 4B) of the feed stalk 440 is disposed within the tubular body 200 through the open end 230. Importantly, the tubular body 200, 300 (in particular, sections 210, 310) is adapted to have a length L for enclosing a portion 472 of the feed stalk 440 in the internal cavity 230 of the tubular body 200; the length L is dependent upon the high-band and low-band ranges of frequencies, so that the common mode resonance of the high-band radiator 130 falls below the low-band range of frequencies. Preferably, the high-band radiator 130 is adapted for the frequency range of 1710 to 2690 MHz. A low-band radiator may be adapted for all or part of the frequency range of 698-960 MHz.

The ultra-wideband antenna 100 may comprise a number of annular dielectric discs (e.g., plastic gaskets). Each dielectric disc can be disposed around the tubular body of a respective high-band radiator 130 and between the annular flange 220, 320 of the high-band radiator 130 and the groundplane 110.

Thus, ultra-wideband multi-band cellular base-station antennas and a high-band radiator for such an antenna described herein and/or shown in the drawings are presented by way of example only and are not limiting as to the scope of the invention. Unless otherwise specifically stated, individual aspects and components of the antennas may be modified, or may have been substituted therefore known equivalents, or as yet unknown substitutes such as may be developed in the future or such as may be found to be acceptable substitutes in the future.

The invention claimed is:

1. A high-band radiator of a dual-band cellular base station antenna, said dual bands comprising low and high bands, said high-band radiator comprising:

at least one dipole comprising two dipole arms made of conductive material adapted for said high band, said at least one dipole spaced at a first distance above a ground plane of the dual-band cellular base station antenna;

a feed stalk for feeding said at least one dipole comprising a non-conductive dielectric substrate body and conductors formed on said substrate body adapted to function as a balun transformer, said feed stalk having a length greater than the first distance, connected with said at least one dipole at one end and having at least one feed connector at the other end, said conductors coupled to said at least one dipole and said at least one feed connector; and a substantially tubular body made of conductive material and having a flange adapted for connection with the ground plane, said tubular body being electrically connected, either directly or by capacitive coupling, through said flange to the ground plane at the open end and short-circuited at the other end to define an internal cavity of said tubular body below the around plane, at least a portion of said feed stalk disposed within the internal cavity of said tubular body through the open end, said tubular body adapted to have said feed connectors extend through said tubular body at the short circuited end, which is spaced at a second distance from said at least one dipole that is greater than the first distance.

2. The high-band radiator as claimed in claim 1, wherein said at least one dipole comprises a pair of crossed dipoles for dual polarization.

3. The high-band radiator as claimed in claim 1, wherein said tubular body is cylindrical, hexagonal or substantially hexagonal.

4. The high-band radiator as claimed in claim 1, wherein the tubular body is adapted to have a length for enclosing a portion of the feed stalk in the internal cavity of the tubular body, said length being dependent upon frequency ranges of the high-band and low-band so that a common mode resonance of the high-band radiator falls below the low-band frequency range.

5. The high-band radiator as claimed in claim 1, wherein said high-band radiator is adapted for the frequency range of 1710 to 2690 MHz.

6. A cellular dual-band base station antenna, said dual band having low and high bands suitable for cellular communications, said dual-band antenna comprising:

a plurality of low-band radiators each adapted for providing clear areas on a ground plane of said dual-band antenna for locating high band radiators in said dual-band antenna; and a plurality of high-band radiators as claimed in claim 1, said high band radiators being configured in at least one array, said low-band radiators being interspersed amongst said high-band radiators at predetermined intervals.

7. The ultra-wideband antenna as claimed in claim 6, further comprising a ground plane having apertures formed in said ground plane, each high-band radiator being disposed in a respective aperture formed in said ground plane.

8. The ultra-wideband antenna as claimed in claim 7, further comprising a plurality of annular dielectric discs, each disposed around said tubular body of a respective high-band radiator and between said flange of said high-band radiator and said ground plane.

9. The ultra-wideband antenna as claimed in claim 6, wherein each low-band radiator is adapted for all or part of the frequency range of 698-960 MHz.

10. A dual-band antenna having a high-band radiator therein, said high-band radiator comprising:

at least one dipole comprising two electrically conductive dipole arms, spaced at a first distance above a ground plane of the dual-band antenna;

a tubular body directly or capacitively coupled to the ground plane, said tubular body having an open end adjacent the ground plane and an at least substantially closed end below the ground plane so that a second distance between the at least substantially closed end and said at least one dipole is greater than the first distance; and a feed stalk having a first end electrically connected to said at least one dipole and a second end disposed proximate the closed end of said tubular body, said feed stalk configured to operate as a balun transformer having a length greater than the first distance.

11. The antenna of claim 10, wherein said feed stalk comprises at least one feed connector at the second end thereof; and wherein the at least one feed connector extends through the at least substantially closed end of said tubular body.

12. The antenna of claim 10, wherein sidewalls of said tubular body are spaced apart from said feed stalk by an annular-shaped air gap; and wherein said tubular body comprises a continuous or segmented annular-shaped flange that is mounted to the ground plane.

13. The antenna of claim 12, wherein the annular-shaped flange is electrically shorted to the ground plane.

14. The antenna of claim 12, wherein the annular-shaped flange is capacitively coupled to the ground plane.

15. The antenna of claim 10, wherein the dual-band antenna includes a low-band radiator operable within a low-band range of frequencies; and wherein a length of said feed stalk enclosed within said tubular body is sufficient to yield a common mode resonance of the high-band radiator at frequency below the low-band range of frequencies.

16. The antenna of claim 10, wherein the high-band radiator is configured to operate at a high-band frequency; and wherein the first distance is equal to about one-quarter of the wavelength of the high-band frequency.

17. A dual-band antenna having low-band and high-band radiators therein, said low-band radiator operable within a low-band range of frequencies and said high-band radiator configured to operate at a high-band frequency and comprising:

at least one dipole comprising two electrically conductive dipole arms, spaced at a first distance above a ground plane of the dual-band antenna; and an elongate feed stalk configured as a balun transformer that extends through an opening in the ground plane, said feed stalk having a first end electrically connected to said at least one dipole and a second end coupled to at least one feed connector associated with the high-band radiator, and wherein a length of said feed stalk is: (i) greater than the first distance, which is equal to about one-quarter of the wavelength ($\lambda/4$) of the high-band frequency, and (ii) sufficient to yield a common mode resonance of the high-band radiator at frequency below the low-band range of frequencies.

18. The antenna of claim 17, further comprising a tubular body that extends below the ground plane relative to said at least one dipole, substantially surrounds the second end of said feed stalk and is electrically shorted to the ground plane.

19. The antenna of claim 17, further comprising a tubular body that extends below the ground plane relative to said at least one dipole, substantially surrounds the second end of said feed stalk and is capacitively coupled to the ground plane.

* * * * *